US010840658B1

(12) United States Patent
Glahe

(10) Patent No.: US 10,840,658 B1
(45) Date of Patent: Nov. 17, 2020

(54) DUMMY GROUND PLUG ADAPTER

(71) Applicant: ABCR, Inc., Denver, CO (US)

(72) Inventor: Charles D. Glahe, Denver, CO (US)

(73) Assignee: ABCR, Inc., Denver, CO (US)

( * ) Notice: Subject to any disclaimer, the term of this patent is extended or adjusted under 35 U.S.C. 154(b) by 0 days.

(21) Appl. No.: 16/733,283

(22) Filed: Jan. 3, 2020

(51) Int. Cl.
*H01R 13/02* (2006.01)
*H01R 31/06* (2006.01)

(52) U.S. Cl.
CPC ..... *H01R 31/06* (2013.01)

(58) Field of Classification Search
CPC ..... H01R 27/02; H01R 31/00
USPC ..... 439/225, 692
See application file for complete search history.

(56) References Cited

U.S. PATENT DOCUMENTS

| | | | | |
|---|---|---|---|---|
| 9,548,578 | B2 * | 1/2017 | Azoulay | H01R 13/717 |
| 9,853,384 | B2 * | 12/2017 | Azoulay | H01R 13/443 |
| 2015/0244124 | A1 * | 8/2015 | Azoulay | H01R 31/065 439/533 |
| 2017/0187135 | A1 * | 6/2017 | Azoulay | H01R 13/6675 |

* cited by examiner

*Primary Examiner* — Phuong Chi Thi Nguyen
(74) *Attorney, Agent, or Firm* — Shifrin Patent Law; Dan Shifrin

(57) ABSTRACT

A dummy ground plug adapter is provided and comprises a base having two parallel, spaced-apart, rectangular slots formed therethrough and a dummy pin extending from a rear surface of the base. The base and dummy pin are formed from an electrically non-conductive material. The size and spacing of the slots and dummy grounding pin conform to the size and spacing of U.S. standard electrical three-prong plugs and outlets, allowing the prongs of a two-prong plug to slip through the slots and be inserted into a three-prong electrical outlet. The presence of the dummy grounding pin provides support and reduces the chance of the plug moving or loosening in the outlet.

2 Claims, 2 Drawing Sheets

DUMMY GROUND PLUG ADAPTER

TECHNICAL FIELD

The present invention relates generally to electrical plugs and, in particular, to providing additional support for devices with two-prong plugs.

BACKGROUND ART

While many electrical devices are equipped with three-prong, grounding plugs, many still are not. Wall chargers and converters are among the devices that typically use a two-prong, non-grounding plug. When these are plugged into an electrical outlets, their weight may cause them to be insecure and loose in the outlet, possibly even falling out of the outlet.

SUMMARY OF THE INVENTION

Embodiments of the present invention provide a dummy ground plug adapter. The adapter comprises a base having two parallel, spaced-apart, rectangular slots formed therethrough and a dummy pin extending from a rear surface of the base. The base and dummy pin are formed from an electrically non-conductive material. The size and spacing of the slots and dummy grounding pin conform to the size and spacing of U.S. standard electrical three-prong plugs and outlets, allowing the prongs of a two-prong plug to slip through the slots and be inserted into a three-prong electrical outlet. The presence of the dummy grounding pin provides support and reduces the chance of the plug moving or loosening in the outlet.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
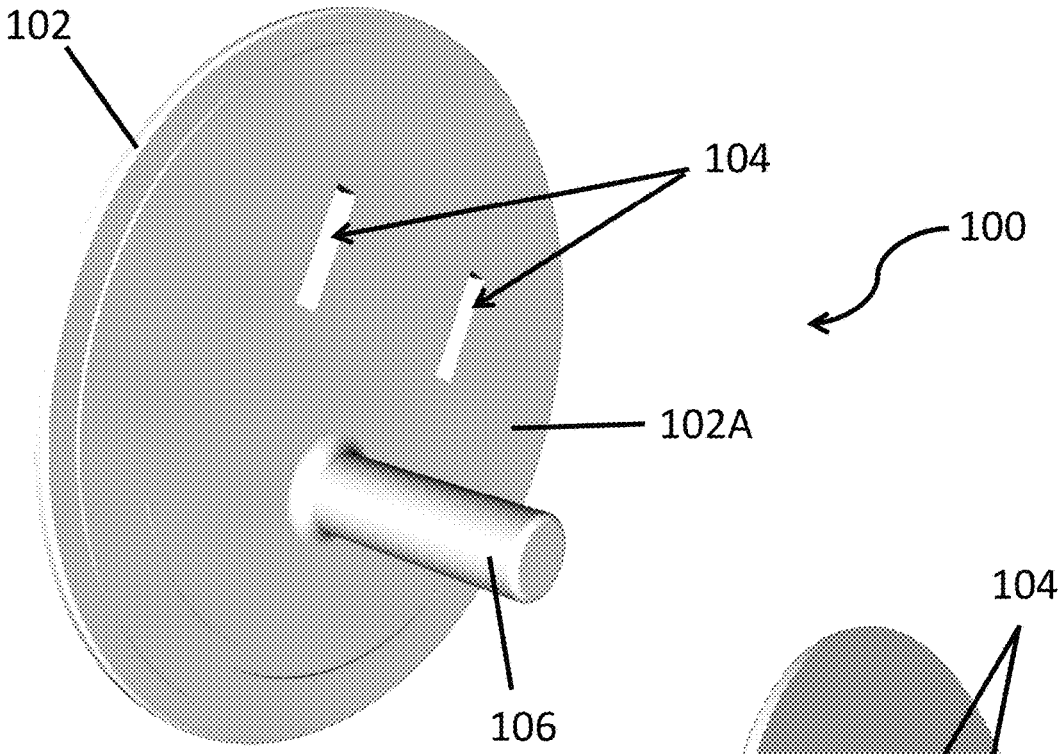
FIG. 1 illustrates a rear perspective view of an embodiment of the dummy ground plug adapter of the present invention.
Figure 2:
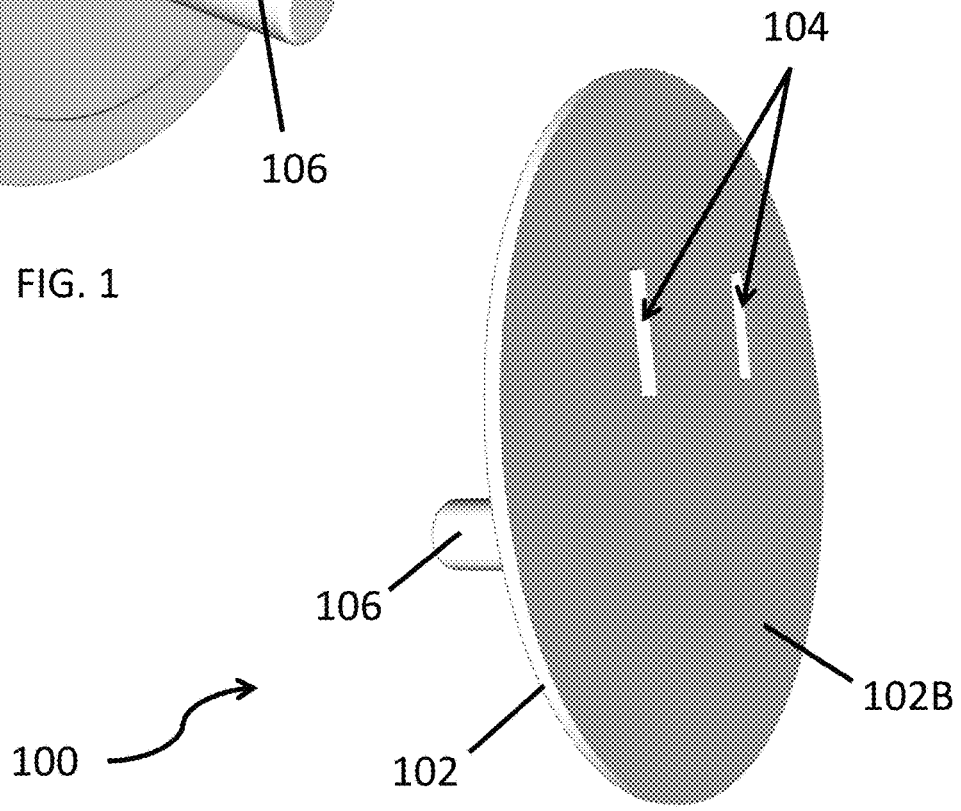
FIG. 2 illustrates a front perspective view of the dummy ground plug adapter of FIG. 1.

FIG. 1 illustrates a rear perspective view of an embodiment of the dummy ground plug adapter 100 of the present invention. The adapter 100 includes a base 102 with two parallel, spaced-apart, rectangular slots 104 sized to allow the prongs of an electrical plug to be inserted therethrough. A dummy grounding pin 106 extends from the rear surface 102A of the base 102 and is configured to fit within the grounding opening of a grounded electrical outlet. FIG. 2 illustrates a front perspective of the adapter 100. The base 102 is relatively thin, such as about 0.05 to about 0.10 inches thick. Both the rear surface 102A and the front surface 102B are substantially flat. The adapter 100, including the dummy pin 106, is formed from a non-conductive material, such as plastic, ABS, nylon, or other like material.

Figure 3:
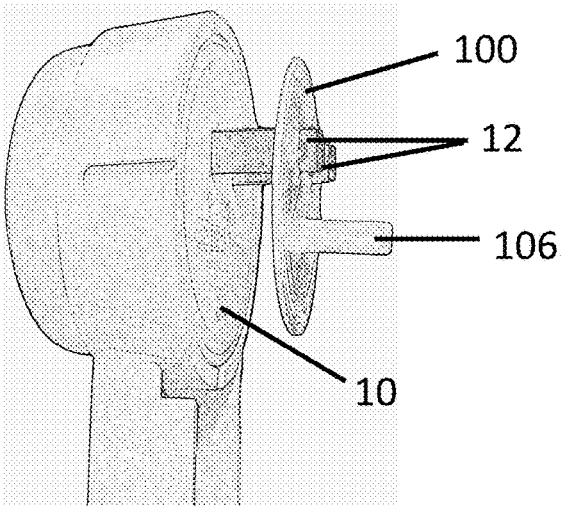
FIG. 3 illustrates the dummy ground plug adapter of FIG. 1 being placed onto a two-prong electrical plug.

FIG. 3 illustrates the ground plug adapter 100 being placed onto an ungrounded plug 10 with two prongs 12. The base 102 of the ground plug adapter 100 is disk-shaped and configured to conform to the size and shape of the plug 10. To install, the slots 104 of the adapter 100 are aligned with and pushed onto the prongs 12. With the dummy adapter 100 in place, the prongs 12 and dummy pin 106 are inserted into a grounded electrical outlet. The dummy pin 106 provides support and helps prevent the shell from moving or loosening in the outlet.

Figure 4:
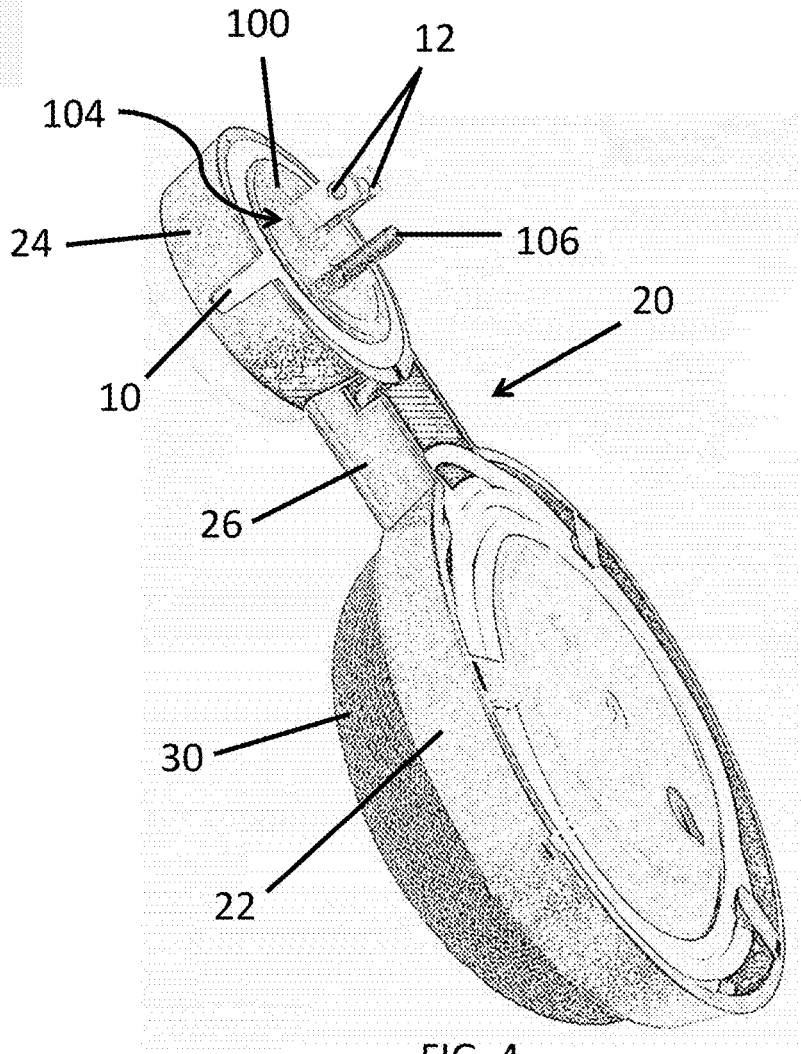
FIG. 4 illustrates an application of the dummy ground plug adapter of FIG. 1.

FIG. 4 illustrates the ground plug adapter 100 as it might be used with a shell 20 that holds an electronic device 30, such as a Google Nest Mini™ smart speaker. The shell 20 includes a round frame 22 to retain the device 30, a second frame 24 to retain a wall converter with the electrical plug 10, and a bridge 26 connecting the two frames 22, 24. The plug 10 has two prongs 12 that extend from the rear of the plug 10.

Although the adapter 100 is illustrated as being disk-shaped to fit a particular application, it will be appreciated that it may be formed in any other shape to accommodate other applications. Further, although the size and spacing of the slots 104 and dummy grounding pin 106 of the adapter 100 illustrated in the FIGs. conform to the size and spacing of U.S. standard electrical three-prong plugs and outlets, the adapter 100 may be formed in other configurations to accommodate other plugs and outlets, such as those used in non-U.S. electrical systems.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A dummy ground plug adapter, comprising:

a base having two parallel, spaced-apart, rectangular slots formed therethrough; and a dummy pin extending from a rear surface of the base; wherein:

the base and dummy pin are formed from an electrically non-conductive material; and the size and spacing of the slots and dummy grounding pin conform to the size and spacing of U.S. standard electrical three-prong plugs and outlets.

2. The dummy ground plug adapter of claim 1, wherein the base is disk-shaped.

* * * * *